US009574376B2

(12) United States Patent
Kananen

(10) Patent No.: US 9,574,376 B2
(45) Date of Patent: Feb. 21, 2017

(54) ELECTROMECHANICAL LOCK

(71) Applicant: iLOQ OY, Oulu (FI)

(72) Inventor: Jyrki Kananen, Oulu (FI)

(73) Assignee: ILOQ OY, Oulu (FI)

( * ) Notice: Subject to any disclaimer, the term of this patent is extended or adjusted under 35 U.S.C. 154(b) by 164 days.

(21) Appl. No.: 14/400,246

(22) PCT Filed: Jun. 10, 2013

(86) PCT No.: PCT/EP2013/061908
§ 371 (c)(1),
(2) Date: Nov. 10, 2014

(87) PCT Pub. No.: WO2013/186166
PCT Pub. Date: Dec. 19, 2013

(65) Prior Publication Data

US 2015/0075235 A1 Mar. 19, 2015

(30) Foreign Application Priority Data

Jun. 12, 2012 (EP) ..... 12171614

(51) Int. Cl.
*E05B 47/06* (2006.01)
*E05B 49/00* (2006.01)
(Continued)

(52) U.S. Cl.
CPC ..... *E05B 49/004* (2013.01); *E05B 15/04* (2013.01); *E05B 47/0001* (2013.01);
(Continued)

(58) Field of Classification Search
CPC ..... Y10T 70/7136; Y10T 70/7102; Y10T 70/7073; Y10T 70/7079; Y10T 70/7107; Y10T 70/7062; E05B 49/004; E05B 47/06; E05B 15/04; E05B 47/0611; E05B 47/0607; E05B 47/063; E05B 2047/0057; E05B 2047/0095; E05B 2015/0472; E05B 2047/0065; E05B 2015/0468; E05B 2047/0064; E05B 2015/041; E05B 2047/0062; E05B 2015/0496; E05B 47/0001
(Continued)

(56) References Cited

U.S. PATENT DOCUMENTS 4,901,545 A 2/1990 Bacon et al.
6,370,928 B1 * 4/2002 Chies ..... E05B 47/0642 70/278.2
8,899,081 B2 * 12/2014 Pukari ..... E05B 47/0012 70/277
(Continued)

FOREIGN PATENT DOCUMENTS

DE 29806098 U1 10/1998
EP 2017413 A1 1/2009
EP 2077412 A1 1/2009
EP 1808816 B1 4/2010
(Continued)

*Primary Examiner* — Lloyd Gall
(74) *Attorney, Agent, or Firm* — Birch, Stewart, Kolasch & Birch, LLP

(57) ABSTRACT

An electromechanical lock includes a lever coupled with a locking mechanism configured to receive mechanical power from an user, and to output the mechanical power to mechanically disengage the locking mechanism provided that a support of the fulcrum is in an open position, and a return mechanism for the support of the fulcrum including a reset spring whose other end is configured to, during the reception of the mechanical power from the user, move past the support of the fulcrum with the mechanical power outputted by the lever, and, finally, force the support of the fulcrum with the mechanical energy outputted by the return spring through the lever back to a locked position.

15 Claims, 4 Drawing Sheets

(51) Int. Cl.
*E05B 15/04* (2006.01)
*E05B 47/00* (2006.01)

(52) U.S. Cl.
CPC ..... *E05B 47/06* (2013.01); *E05B 47/063* (2013.01); *E05B 47/0607* (2013.01); *E05B 47/0611* (2013.01); *E05B 2015/041* (2013.01); *E05B 2015/0468* (2013.01); *E05B 2015/0472* (2013.01); *E05B 2015/0496* (2013.01); *E05B 2047/0057* (2013.01); *E05B 2047/0062* (2013.01); *E05B 2047/0064* (2013.01); *E05B 2047/0065* (2013.01); *E05B 2047/0095* (2013.01); *Y10T 70/7073* (2015.04); *Y10T 70/7102* (2015.04); *Y10T 70/7136* (2015.04)

(58) Field of Classification Search
USPC ..... 70/283, 277, 278.3, 278.2, 278.7, 283.1, 70/222, 223, 279.1; 340/5.65, 542
See application file for complete search history.

(56) References Cited

U.S. PATENT DOCUMENTS

| | | | | |
|---|---|---|---|---|
| 2009/0229326 | A1* | 9/2009 | Pukari | E05B 47/063 70/263 |
| 2010/0139343 | A1* | 6/2010 | Pukari | G07C 9/00309 70/283.1 |
| 2010/0188190 | A1* | 7/2010 | Pukari | E05B 47/063 340/5.6 |
| 2011/0174029 | A1* | 7/2011 | Lappalainen | E05B 47/0611 70/279.1 |
| 2011/0259062 | A1 | 10/2011 | Spycher et al. | |

FOREIGN PATENT DOCUMENTS

| | | | |
|---|---|---|---|
| EP | 2385196 | A2 | 11/2011 |
| EP | 2336460 | B1 | 5/2012 |
| EP | 2017795 | B1 | 6/2012 |

* cited by examiner

ELECTROMECHANICAL LOCK

FIELD

The invention relates to an electromechanical lock.

BACKGROUND

Electromechanical locks are replacing the traditional mechanical locks. Further refinement is needed for making the electromechanical locks to consume as little electric power as possible, also during the return of the lock to a closed state. This is especially important with self-powered locks, or with such locks that import electric energy sporadically from some external source.

BRIEF DESCRIPTION

The present invention seeks to provide an improved electromechanical lock.

According to an aspect of the present invention, there is provided an electromechanical lock, comprising: an electronic circuit configured to read data from an external source, and match the data against a predetermined criterion; a support of a fulcrum configured to move by electric power to an open position provided that the data matches the predetermined criterion; a locking mechanism configured to hold the lock, when engaged, in a locked state, and, when disengaged, in a mechanically openable state; a lever coupled with the locking mechanism configured to receive mechanical power from an user to store mechanical energy to a return spring, and to output the mechanical power to mechanically disengage the locking mechanism provided that the support of the fulcrum is in the open position; and a return mechanism for the support of the fulcrum comprising a reset spring whose other end is configured to, during the reception of the mechanical power from the user, move past the support of the fulcrum with the mechanical power outputted by the lever, and, finally, force the support of the fulcrum with the mechanical energy outputted by the return spring through the lever back to a locked position.

LIST OF DRAWINGS

Example embodiments of the present invention are described below, by way of example only, with reference to the accompanying drawings, in which FIG. 1 illustrates an example embodiment of an electromechanical lock;

DESCRIPTION OF EMBODIMENTS

Figure 1:
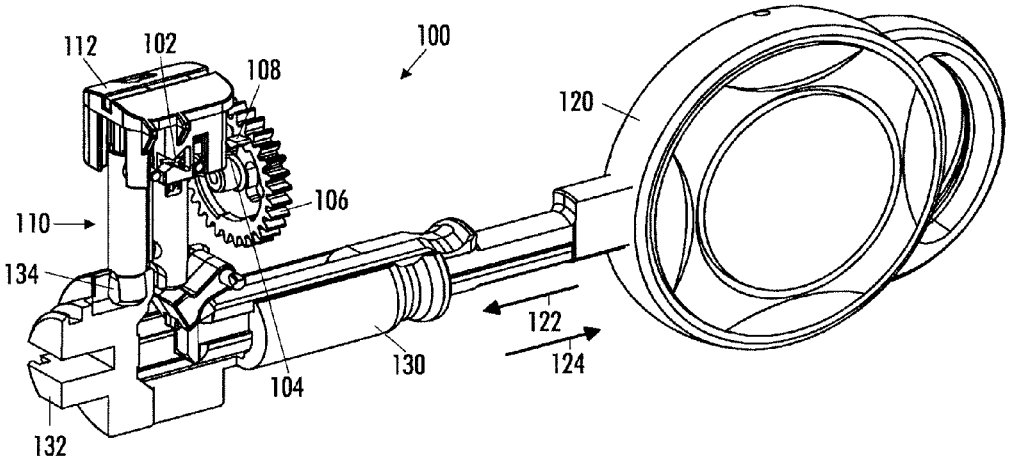

The following embodiments are only examples. Although the specification may refer to "an" embodiment in several locations, this does not necessarily mean that each such reference is to the same embodiment(s), or that the feature only applies to a single embodiment. Single features of different embodiments may also be combined to provide other embodiments. Furthermore, words "comprising" and "including" should be understood as not limiting the described embodiments to consist of only those features that have been mentioned and such embodiments may contain also features/structures that have not been specifically mentioned.

The Applicant has invented many improvements for the electromechanical locks, such as those disclosed in EP applications 05112272.9, 07112677.5, 07112676.7, 07112673.4, and 09180117.5, for example.

The present embodiments may be employed in the self-powered electromechanical lock disclosed in those applications. Consequently, a complete discussion of all those details is not repeated here, but the reader is advised to consult those applications, and especially EP 07112673.4 (to which the reference numerals in this paragraph refer to) disclosing a self-powered electromechanical lock generating electric energy from the key 100 insertion, and comprising an electronic circuit 326 configured to read data from a key, and match the data against a predetermined criterion, a support 342 of a fulcrum configured to move by electric power to an open position provided that the data matches the predetermined criterion, and a locking mechanism (such as a locking pin) 318 configured to hold the lock, when engaged, in a locked state, and, when disengaged, in a mechanically openable state.

However, the present embodiments may also be employed in further developed versions of those locks, such as locks that import electric energy sporadically from some external source. In an example embodiment, the electric energy may be obtained from a radio frequency field utilized in radio-frequency identification (RFID) technology. In an example embodiment, near field communication (NFC) may be utilized. NFC is a set of standards for smartphones and similar devices to establish radio communication with each other by touching them together or bringing them into close proximity. NFC utilizes various short-range wireless technologies, typically requiring a distance of four centimetres or less. With NFC, a reader (within a smartphone, for example), also known as an initiator, generates a radio frequency field powering the electronics of the lock and also providing electric energy for the operation of an actuator (such as a support of a fulcrum). In such embodiments, a key also becomes obsolete, as the smartphone holds the data (which is otherwise held by the key).

Let us now turn to FIG. 1, which illustrates an example embodiment of the electromechanical lock 100, but only such parts of the lock 100 are shown that are relevant to the present example embodiments. A guide cover 112 obscures the parts, but a locking mechanism 110 is visible, as well as a gearwheel 106 with a support 108 of a fulcrum, and, furthermore a reset spring 102 and its other end 104. Also a key 120 for the lock 100 is illustrated, but as was envisaged, it is not necessary in all example embodiments.

Figure 2A:
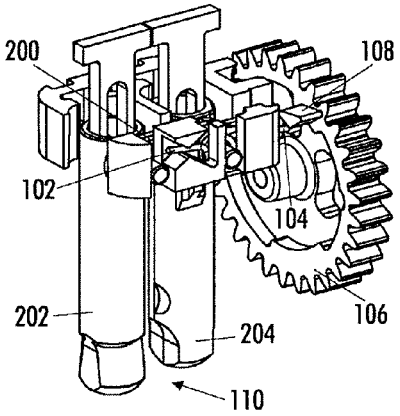
FIGS. 2A, 2B and 2C illustrate the lock in a locked state.
Figure 2B:
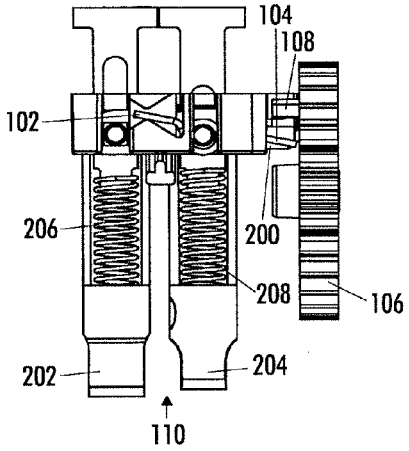
Figure 2C:
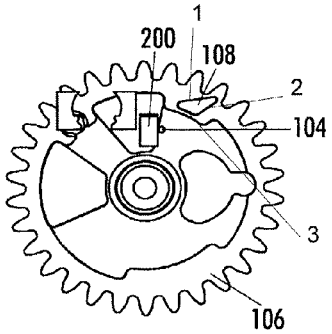

In FIGS. 2A and 2B, the guide cover 112 is removed to clarify the structure, and FIG. 2C illustrates some details relating to the support 108 of the fulcrum.

The lock 100 further comprises a lever 200 coupled with the locking mechanism 110 configured to receive mechanical power from a user to store mechanical energy to a return spring 208, and to output the mechanical power to mechanically disengage the locking mechanism 110 provided that the support 108 of the fulcrum is in the open position. In the example embodiments illustrated in the Figures, the external source, from which the data is read, is the key 120, and the lever 200 is configured to receive the mechanical power from the insertion 122 of the key 120 into the lock 100 by the user. Besides receiving the mechanical power from the user by the key 120 insertion 122, other mechanisms may also be utilized for the mechanical power reception, such as various user-operated mechanical lock elements (knobs etc.) operated by turning, pushing, or pulling them, for example.

FIGS. 2A, 2B and 2C illustrate the lock 100 in a locked state, which is considered both a starting point and an end point for a normal operation cycle. In example embodiments illustrated in this application, the open position of the support 108 of the fulcrum provides a fulcrum for the lever 200, and, as is shown in FIGS. 2A, 2B and 2C, the support 108 of the fulcrum is displaced from the lever 200, i.e. even if the lever 200 moves, it does not meet the support 108 of the fulcrum and the lock 100 remains in the locked state. However, a reversed example embodiment (not illustrated in this application) is also feasible, wherein in the locked position the support 108 of the fulcrum is provided, and accordingly, the open position of the support 108 of the fulcrum does not provide a fulcrum for the lever 200.

The lock 100 further comprises a return mechanism for the support 108 of the fulcrum comprising the reset spring 102 whose other end 104 is configured to, during the reception of the mechanical power from the user (in some example embodiments during the insertion 122 of the key 120), move past the support 108 of the fulcrum with the mechanical power outputted by the lever 200, and, finally (in some example embodiments during the removal 124 of the key 120), force the support 108 of the fulcrum with the mechanical energy outputted by the return spring 208 through the lever 200 back to a locked position. In some embodiments, the return mechanism is configured to operate during the removal 124 of the key 120.

Figure 3A:
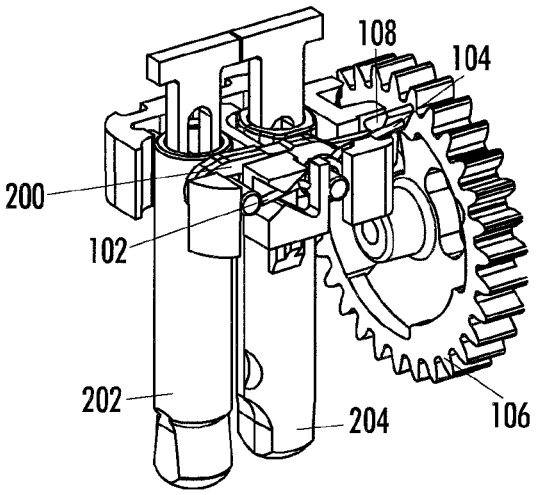
FIGS. 3A, 3B and 3C illustrate the lock during opening.
Figure 3B:
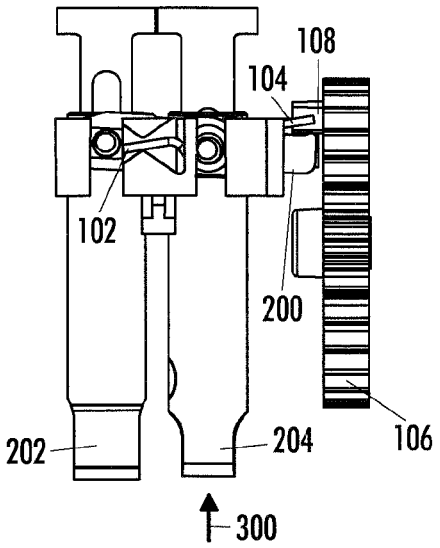
Figure 3C:
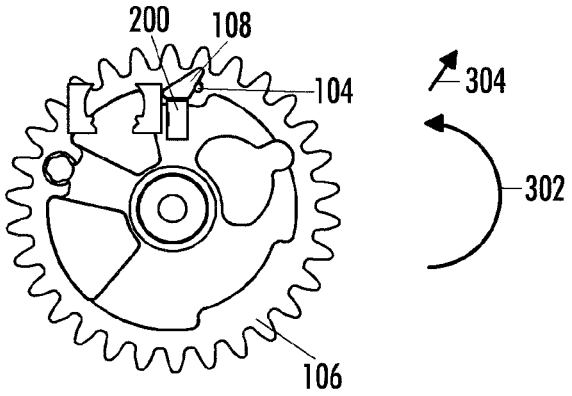

FIGS. 3A, 3B and 3C illustrate the lock 100 during opening. The electronic circuit has read data from the key 120, and matched the data against a predetermined criterion, and the support 108 of the fulcrum has been moved by the electric power to an open position as the data matched the predetermined criterion. In FIGS. 3A, 3B and 3C this is implemented such that the gear wheel 106 has been rotated 302 counterclockwise, and, accordingly, the support 108 of the fulcrum is now by the lever 200.

In an example embodiment, the other end 104 of the reset spring 102 is configured to move 304 past the support 108 of the fulcrum after the support 108 of the fulcrum is moved into the open position, whereby the reset spring 102 does not exert pressure against the moving of the support 108 of the fulcrum into the open position with the electric power. In FIG. 3C it is shown that the other end 104 of the reset spring 102 moves past the support 108 of the fulcrum in direction of the arrow 304.

Figure 5A:
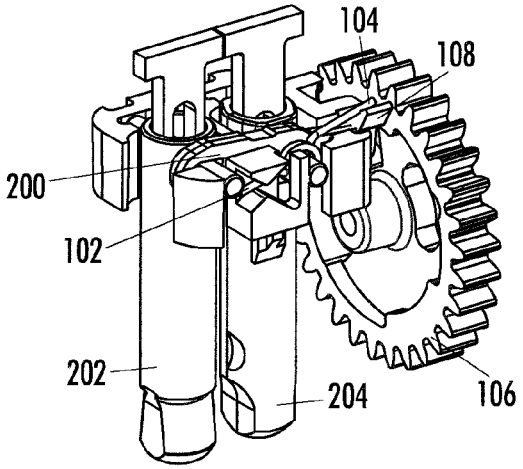
FIGS. 5A, 5B and 5C illustrate the lock during closing.
Figure 5B:
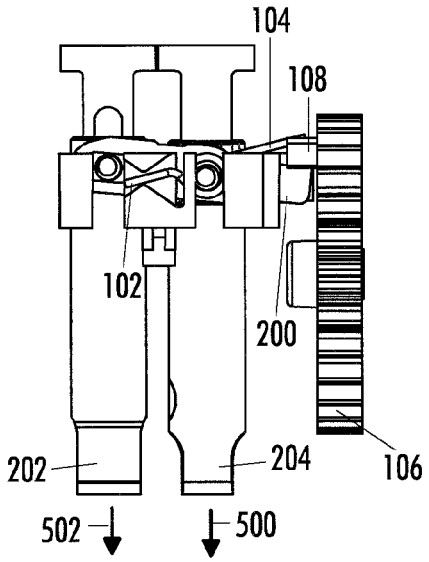

In an example embodiment illustrated in FIG. 5B, the return mechanism operates (during the removal of the key 120) by the mechanical energy 500 outputted by the return spring 208 through the lever 200. This operation of the return mechanism may partly be aided by mechanical energy 502 of another return spring 206 of the locking pin 202. In example embodiments employing the key 120, the return mechanism operates as the key 120 is removed, without requiring a special return shape in the key 120 to be coupled with the lever 200 during the removal 124 of the key 120.

In an example embodiment, the other end 104 of the reset spring 102 is free to move about the support 108 of the fulcrum during the reception of the mechanical power from the user and during forcing the support 108 of the fulcrum back to the locked position, i.e., in the example embodiments employing the key 120, the other end 104 of the reset spring 102 moves during the insertion 122 of the key 120 into the lock 100 and during the removal 124 of the key 120 from the lock 100.

In an example embodiment, the support 108 of the fulcrum comprises at least two surfaces, and wherein the other end 104 of the reset spring 102, during the reception of the mechanical power from the user (in the example embodiments with the key 120, during the insertion 122 of the key 120), moves along the first surface 1, and, wherein the other end 104 of the reset spring 102, during forcing the support 108 of the fulcrum back to the locked position (in the example embodiments with the key 120, during the removal 124 of the key 120), exerts spring force against the second surface 2 to move the support 108 of the fulcrum back to the locked position.

In an example embodiment, the support 108 of the fulcrum comprises a substantially triangular shape. In an example embodiment, the other end 104 of the reset spring 102, during the reception of the mechanical power from the user (in the example embodiments with the key 120, during the insertion 122 of the key 120), moves along the first side 1 of the triangular shape to the second side 2 of the triangular shape, and, the other end 104 of the reset spring 102, during forcing the support 108 of the fulcrum back to the locked position (in the example embodiments with the key 120, during the removal 124 of the key 120), exerts spring force against the second side 2 of the triangular shape, whereupon, after the support 108 of the fulcrum has moved back to the locked position, the other end 104 of the reset spring 102 moves such that the other end 104 of the reset spring 102 is not in the way when the support 108 of the fulcrum moves from the closed position to the open position in the next opening cycle. In the example embodiment shown in FIGS. 2A, 2B and 2C, the other end 104 of the reset spring 102 is on the third side 3 of the triangular shape.

In an example embodiment, the support 108 of the fulcrum is a part of the gearwheel 106 moved by a rotating shaft of an electric motor or an electric generator, as illustrated in EP 07112673.4.

In an example embodiment, illustrated also in EP 07112673.4, the lock 100 further comprises an electric generator configured to generate the electric power from the mechanical power received from the user (in the example embodiments with the key 120, from the insertion 122 of the key 120 into the lock 100). In an example embodiment, illustrated also in EP 07112673.4, the electric generator is further configured to first generate the electric power and feed the electric power to the electronic circuit, and thereupon to move the support 108 of the fulcrum with the electric power.

Figure 4A:
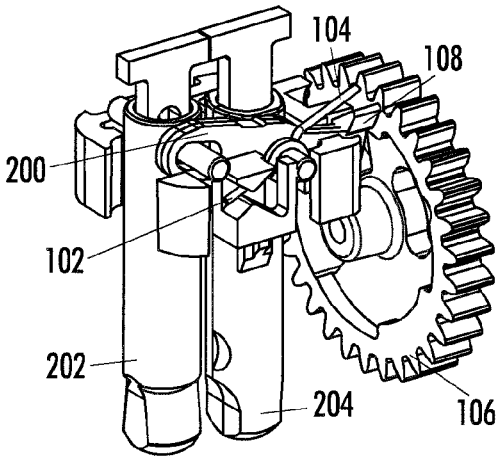
FIGS. 4A, 4B and 4C illustrate the lock in an open state.
Figure 4B:
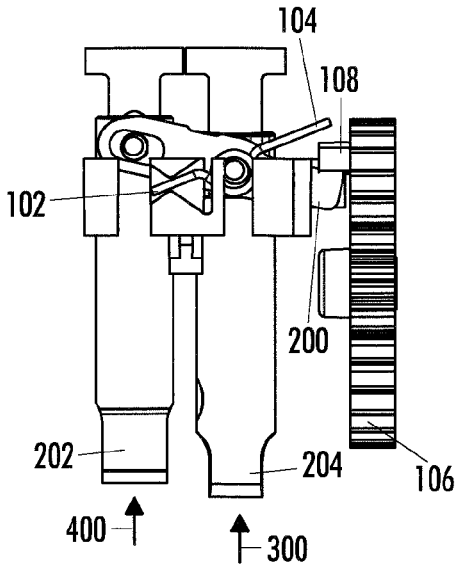
Figure 4C:
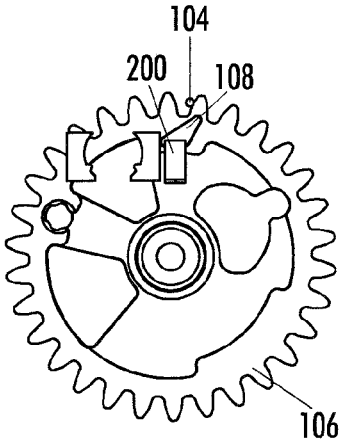

FIGS. 4A, 4B and 4C illustrate the lock 100 in an open state: the other end 104 of the reset spring 102 has now moved past the support 108 of the fulcrum (from under the support to above the support).

In an example embodiment, illustrated also in EP 07112673.4, the lock further comprises a driving mechanism coupled with the lever 200 configured to input the mechanical power to the lever 200.

In an example embodiment, illustrated also in EP 07112673.4, the locking mechanism 110 comprises a locking pin 202 and the driving mechanism comprises a driving pin 204, and the lever 200 couples the driving pin 204 to the locking pin 202 to output the mechanical power (in the example embodiments with the key 120, received from the insertion 122 of the key 120 into the lock 100) to mechanically disengage the locking pin 202 provided that the support 108 of the fulcrum is in the open position. As shown in FIG. 3B, the driving pin 204 moves into the direction of arrow 300 while the key 120 is inserted 122, and, as shown in FIG. 4B, the movement 300 of the driving pin 204 causes through the force levered by the lever 200 utilizing the support 108 of the fulcrum the movement of the locking pin 202 into the direction of arrow 400. As shown in FIG. 2B, the locking pin 202 is also provided with a return spring 206. The locking pin 202 and the driving pin 204 are both returned to their initial position by the return springs 206, 208, while the spring force also serves to force the support 108 of the fulcrum back to the locked position through the lever 200 and the other end 104 of the reset spring 102.

In an example embodiment of FIG. 1, illustrated also in EP 07112673.4, the lock 100 further comprises a lock cylinder 132, and the locking mechanism 110 is further configured to implement the locked state so that, when engaged, the locking mechanism 100 holds the lock cylinder 132 stationary, and to implement the mechanically openable state so that, when disengaged, the locking mechanism 110 releases the lock cylinder 132 rotatable by mechanical power. This may be implemented such that the free end of the locking pin 202 of the locking mechanism 110 is received by a hole 134 (cut open in FIG. 1 for clarifying the illustration) in the lock cylinder 132 when in the locked state, so that the locking pin 202 immobilizes the locking cylinder 132, i.e., the locking pin 202 prohibits the rotation of the lock cylinder 132. FIG. 1 also illustrates keyways 130 of the lock 100.

Figure 5C:
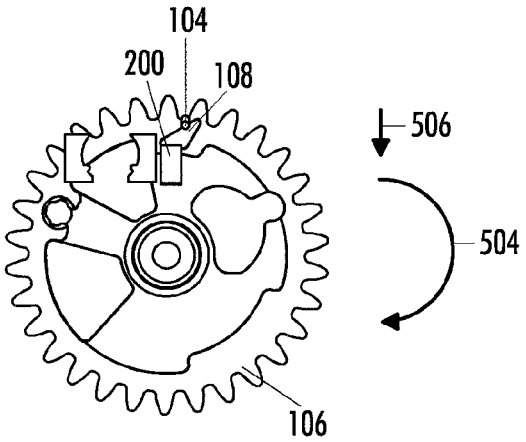

FIGS. 5A, 5B and 5C illustrate the lock 100 during closing.

As was explained earlier, the other end 104 of the reset spring 102 (in the example embodiments with the key 120, during the removal 124 of the key 120) forces the support 108 of the fulcrum with the mechanical energy outputted by the return spring 208 through the lever 200 back to the locked position. As shown in FIG. 5C, the other end 104 of the reset spring 102 moves into the direction of arrow 506 and forces the support 108 of the fulcrum to move with the forced turning of the gearwheel 106 into the direction of arrow 504. The resulting locked state is the one illustrated with reference to FIGS. 2A, 2B and 2C as the starting position.

As the whole operating cycle has now been described, we may once more examine the already mentioned example embodiment, wherein the support 108 of the fulcrum comprises the substantially triangular shape. As shown in FIG. 3C, the other end 104 of the reset spring 102, during the reception of the mechanical power from the user (in the example embodiments with the key 120, during the insertion 122 of the key 120), moves in direction 304 along the first side of the triangular shape to the second side of the triangular shape resulting in the open state illustrated in FIG. 4C. As shown in FIG. 5C, the other end 104 of the reset spring 102 (in the example embodiments with the key 120, during the removal 124 of the key 120) exerts spring force in direction 506 against the second side of the triangular shape, whereupon, after the support 108 of the fulcrum has moved back to the locked position, the other end 104 of the reset spring 102 moves to a position nearby the third side of the triangular shape as shown in FIG. 2C.

Three different springs may be utilized in the example embodiments: the reset spring 102, the return spring 208, and the return spring 206. The spring may be defined as an elastic object used to store mechanical energy. In an example embodiment, the reset spring 102 is a torsion spring. In an example embodiment, the return spring 208 is a compression spring. In an example embodiment, the return spring 206 is a compression spring.

It will be obvious to a person skilled in the art that, as technology advances, the inventive concept can be implemented in various ways. The invention and its embodiments are not limited to the example embodiments described above but may vary within the scope of the claims.

The invention claimed is:

1. An electromechanical lock, comprising:

an electronic circuit configured to read data from an external source, and match the data against a predetermined criterion;

a support configured to move by electric power to an open position provided that the data matches the predetermined criterion;

a locking mechanism configured to hold the lock, when engaged, in a locked state, and, when disengaged, in a mechanically openable state;

a lever coupled with the locking mechanism configured to receive mechanical power from a user to store mechanical energy to a return spring, and to output the mechanical power to mechanically disengage the locking mechanism from a locked state provided that the support is in the open position; and a return mechanism for the support comprising a reset spring whose end is configured to, during the reception of the mechanical power from the user, move past the support with mechanical power outputted by the lever, and, finally, force the support with the mechanical energy outputted by the return spring to a locked position.

2. The lock of claim 1, wherein the end of the reset spring is configured to move past the support after the support is moved into the open position, whereby the reset spring does not exert pressure against the moving of the support into the open position with the electric power.

3. The lock of claim 1, wherein the return mechanism operates by the mechanical energy outputted by the return spring.

4. The lock of claim 1, wherein the end of the reset spring is free to move about the support during the reception of the mechanical power from the user and during forcing the support back to the locked position.

5. The lock of claim 1, wherein the support comprises at least two surfaces, and wherein the end of the reset spring, during the reception of the mechanical power from the user, moves along a first surface, and, wherein the end of the reset spring, during forcing the support back to the locked position, exerts spring force against a second surface to move the support back to the locked position.

6. The lock of claim 1, wherein the support comprises a substantially triangular shape.

7. The lock of claim 6, wherein the end of the reset spring, during the reception of the mechanical power from the user, moves along a first side of the triangular shape to a second side of the triangular shape, and, the end of the reset spring, during forcing the support back to the locked position, exerts spring force against the second side of the triangular shape, whereupon, after the support has moved back to the locked position, the end of the reset spring moves such that the end of the reset spring is not in the way when the support moves from the closed position to the open position in the next opening cycle.

8. The lock of claim 1, wherein the support is a part of a gearwheel moved by a rotating shaft of an electric motor or an electric generator.

9. The lock of claim 1, further comprising an electric generator configured to generate the electric power from the mechanical power received from the user.

10. The lock of claim 9, wherein the electric generator is further configured to first generate the electric power and feed the electric power to the electronic circuit, and thereupon to move the support with the electric power.

11. The lock of claim 1, further comprising a driving mechanism coupled with the lever configured to input the mechanical power to the lever.

12. The lock of claim 1, wherein the locking mechanism comprises a locking pin and a driving mechanism comprises a driving pin coupled with the return spring, and the lever couples the driving pin to the locking pin to output the mechanical power to mechanically disengage the locking pin from a lock cylinder of the locking mechanism provided that the support is in the open position.

13. The lock of claim 1, wherein the lock further comprises a lock cylinder, and the locking mechanism is further configured to implement the locked state so that, when engaged, the locking mechanism holds the lock cylinder stationary, and to implement the mechanically openable state so that, when disengaged, the locking mechanism releases the lock cylinder rotatable by mechanical power.

14. The lock of claim 1, wherein the open position of the support provides a fulcrum for the lever.

15. The lock of claim 1, wherein the external source is a key, and the lever is configured to receive the mechanical power from an insertion of the key into the lock by the user.

* * * * *